US006220169B1

(12) United States Patent
Rosenquist et al.

(10) Patent No.: US 6,220,169 B1
(45) Date of Patent: Apr. 24, 2001

(54) METHOD OF PLACING RAIL SECTIONS AND A MEANS THEREFOR

(75) Inventors: Karl Anders Rosenquist; Erne Holmberg; Per Olof Ohlsson, all of Hudiksvall (SE)

(73) Assignee: A.Rosenquist Förvaltnings AB, Hudiksvall (SE)

( * ) Notice: Subject to any disclaimer, the term of this patent is extended or adjusted under 35 U.S.C. 154(b) by 0 days.

(21) Appl. No.: 09/269,876

(22) PCT Filed: Sep. 9, 1997

(86) PCT No.: PCT/SE97/01518

§ 371 Date: Nov. 9, 1999

§ 102(e) Date: Nov. 9, 1999

(87) PCT Pub. No.: WO98/13551

PCT Pub. Date: Apr. 2, 1998

(30) Foreign Application Priority Data

Sep. 9, 1996 (SE) ..... 9603272
Sep. 23, 1996 (SE) ..... 9603481

(51) Int. Cl.[7] ..... E01B 29/00

(52) U.S. Cl. ..... 104/2; 104/7.1; 29/271; 29/267

(58) Field of Search ..... 104/2, 7.1; 29/271, 29/267, 281.4

(56) References Cited

U.S. PATENT DOCUMENTS 1,754,662 * 4/1930 Woodbury et al. ..... 104/2
3,330,219 * 7/1967 Plasser et al. ..... 104/2
3,604,358 * 9/1971 Frantz et al. ..... 104/6
3,896,734 7/1975 Plasser et al. .
4,002,320 1/1977 Weber .
4,205,612 * 6/1980 Luttig ..... 104/1 R

FOREIGN PATENT DOCUMENTS 337749 7/1997 (AT) .
1808696 7/1969 (DE) .
29501077 U 4/1995 (DE) .
0551798A1 7/1993 (EP) .
0699802A1 3/1996 (EP) .
WO89/05254 6/1989 (WO) .

* cited by examiner

*Primary Examiner*—S. Joseph Morano
*Assistant Examiner*—Frantz F. Jules
(74) *Attorney, Agent, or Firm*—Burns, Doane, Swecker & Mathis LLP

(57) ABSTRACT

The invention relates to a method of placing, positioning and fastening railroad sections on railroad rail sections (1) on a number of mutually adjacent and mutually spaced, loose railroad sleepers (2*a*, 2*b*), with the aid of a pulling vehicle (7) which functions to pull a rail section (1) from a first railroad wagon (4) into abutment with said sleepers, via a second railroad wagon (5). Rail sections (1) pulled from the wagon by said vehicle (7) are moved linearly at a distance (a) above the sleepers (2*a*, 2*b*) with the aid of a number of devices (10, 10*a*, 10*b*). This linear movement is adapted so that the trailing end-surface (1') of the pulled rail section will be positioned adjacent a leading end-surface (1") of an earlier laid rail section. In this position of the rail section, one or more of said devices (10, 10*a*, 10*b*) is/are activated to lower the rail section (1) onto rail-adapted, sleeper-associated fastener elements (81–84). The invention also relates to a method of creating conditions whereby tensile forces acting in railroad rails that are fastened to railroad sleepers can be adapted or neutralized. The invention also relates to a device for use to this end.

29 Claims, 6 Drawing Sheets

METHOD OF PLACING RAIL SECTIONS AND A MEANS THEREFOR

FIELD OF INVENTION

The present invention relates primarily to a method of successively placing, positioning and thereafter fastering rail sections on and to a number of mutual adjacent and mutually spaced railroad sleepers, where each sleeper is placed loosely on a prepared railroad bed.

The method utilizes a first railroad wagon adapted to carry a plurality of rail sections, a second railroad wagon or like vehicle adapted to guide rail sections taken successively from said plurality of rail sections on said first wagon onto said loosely resting sleepers with the aid of a pulling vehicle, such as a tractor, that functions to pull one rail section at a time from said first wagon and into abutment with said sleepers, via said second wagon.

The present invention also relates to a method of lifting and moving a previously positioned rail relative to a railroad sleeper and lowering the rail onto the sleeper, therewith providing conditions for adapting or neutralizing tension forces acting in a rail that is fastened to railroad sleepers.

Such a method comprises the following steps, although not necessarily in a consecutive order:

a) cutting away an end part of the rail;

b) loosening fastener elements between sleepers and rail along an adapted rail section;

c) lifting said rail section slightly above said loosened sleepers;

d) applying a pre-determined force to the loosened rail section in direction of its longitudinal axis;

e) fastening the end surface of the rail section to an exposed end-surface of an adjacent rail section that is fastened to railroad sleepers, under the action of a force; and f) fastening the loose rail section acted upon by said force to underlying railroad sleepers with the aid of fastener elements.

The present invention also relates to a device for use in the inventive method, such as to facilitate linear movement of rail sections, along the sleepers.

The device is also adapted to provide the possibility to lift and move a rail relative to a railroad sleeper and to lower the rail onto said sleeper, which can be used when practicing the inventive method.

BACKGROUND OF THE INVENTION

A number of different methods of placing, positioning and thereafter permanently fastening rail sections on rail sections on a number of mutually adjacent and mutually spaced, loose railroad sleepers each of which rests loosely on a railroad bed are known to the art.

By "loosely placed" is meant that a rail section is not fastened to underlying sleepers with the aid of fastener devices and that the sleepers are able to move relative to the underlying surface, preferably a prepared railroad bed, in response to a small force.

The method that can be considered to lie closest to the invention is the method that requires the use of a first railroad wagon which is adapted to carry a store of railroad rail sections, a second railroad wagon or like vehicle adapted to guide the successively withdrawn and linearly displaced rail sections from said first wagon onto said railroad sleepers.

It is also known in conjunction with this method to draw a rail section from the store of rail sections on the first wagon over loose sleepers via said second wagon, and to brinc said rail section into abutment with said sleepers with the aid of a pulling vehicle, such as a tractor, having gripping devices and means adapted for coaction with the end-part of the withdrawn rail section.

The earlier known method requires both the first wagon and the second wagon or like vehicle to run along provisionally placed and secured rail sections that are separate from the permanent rail sections to be placed on and permanently secured to the sleepers at a distance apart corresponding to the gauge or track of the normal railroad traffic.

This earlier known method allows rail sections intended to be permanently positioned by the pulling vehicle to extend on the loose railroad sleepers.

The different forces acting on the sleepers as the rail sections slide therealong are liable to cause the earlier established spacing between the sleepers to be disturbed.

Bearing in mind that a rail section of the kind to which the invention refers may have a length of about 100 m or more, it will be understood that the sleepers are subjected to very high pressure forces and that the sleepers are very liable to tilt or tip as a result of these forces.

The method recited in the introduction for creating conditions whereby a previously positioned rail can be lifted and moved relative to a railroad sleeper and the rail lowered onto the sleeper and therewith create conditions for adapting or neutralizing tension forces acting in rails that are fastened to sleepers is known to the art.

The rail section has earlier been lifted from the loosened sleepers with the aid of hand-operated lever, a crowbar or some like device.

It has also been proposed to place rollers between the raised rail section and the sleeper, and to permit the entire rail section to rest on a number of such rollers.

This method is laborious, however, while application of rollers on the sleepers is made complicated by virtue of needing to place in the close proximity of the sleeper fastening elements.

The present invention also relates to a device that can be used beneficially when practicing the inventive method. With regard to the prior standpoint of techniques it should be mentioned that it is known within other technical fields and other applications to rotatably mount a support surface or roller on mutually opposing end-wall parts with the aid of suitable bearing means.

It is also known to rotatably or pivotally mount one or more end-wall part on a supportive structure.

The patent publication DT-B2-18 08 696 discloses a plant whereby new railroad sections are distributed and arranged along the railroad bed simultaneously as old railroad sections are taken away.

By the publication AT-B-337 749 it is previously known a device to lift or lower loose railroad sections by the use of lever arm system using an excentric disc causing to lift and to lower a turnable plate, its free end portions having spheres supporting the railroad sections.

SUMMARY OF THE INVENTION

TECHNICAL PROBLEMS

When taking into consideration the technical deliverations that a person skilled in this particular art must make in order to provide a solution to one or more technical problems that he/she encounters, it will be seen that on the one hand it is necessary initially to realize the measures and/or the sequence of measures that must be undertaken to this end, and on the other hand to realize which means is/are required to solve one or more of said problems. Oil this basis, it will be evident that the technical problems listed below are highly relevant to thie development of the present invention.

When considering the earlier standpoint of techniques as described above it will be obvious that a technical problem is one of providing a method of placing rail sections successively onto a number of aligned railroad sleepers with no risk, or only a slight risk, of this alignment being disturbed and loosely placed sleepers being shifted and/or being moved out of alignment.

It will also be seen that another technical problem is one of providing a method in which rail sections can be aligned with sleeper-associated fastener elements both simply and quickly.

Another technical problem is one of realizing the significance of allowing the wagons required for laying-out rail sections to move along rail sections that have been fastened provisionally to the sleepers prior to fastening said rail sections permanently to each railroad sleeper with the aid of equipment that follows the rail laying operation.

When considering the present state of the art, as described above, it will be evident that a technical problem exists in providing a modified method for creating conditions which enable a rail to be lifted and moved relative to a railroad sleeper and lowered onto said sleeper while adapting or neutralizing tension forces acting in rails that are fastened to sleepers, where raising of the rail section slightly above the loosened sleepers can be effected in a simple fashion.

Another technical problem resides in the provision of a device that will enable rail section after rail section to pass over loose sleepers in the absence of friction, or with only very little friction and therewith small tilting forces acting on a few positioned sleepers, and therewith enable in practice rail sections to be laid successively without the risk of said loose sleepers, or at least the majority of the sleepers, being moved to a position that deviates from a predetermined position.

It will also be seen that another technical problem is one of realizing the significance of providing a separate device to this end and of realizing the form that such a device should take and also the advantage that is afforded by placing a plurality of such devices sequentially along loose railroad sleepers and along an anticipated path of a rail section.

Another technical problem is one of realizing the significance of positioning said devices are positioned so that the withdrawn rail section will extend along a path which conforms with the orientation of similarly positioned sleeper-associated and rail-adapted fastener elements, and realizing advantages that are afforded hereby.

Another technical problem is one of providing conditions with the aid of simple means which will enable a rail section that is pulled, or withdrawn, from said store of rail sections and placed along the sleepers and rests against a number of devices and therewith placed over the sleepers to be moved linearly or pressed back to achieve end-to-end contact with an adjacent rail section that has already been provisionally secured.

Still another technical problem is one of realizing the measures that are required in order to enable railroad wagons to pass along rail sections that have been provisionally secured to a few railroad sleepers.

By provisionally secured rail sections is meant sections that are not secured permanently to a few underlying sleepers, and that this provisional fastening is released immediately before each sleeper is fastened permanently to said rail section.

It will also be seen that another technical problem is one of providing a device of such construction as to enable it to be activated easily by hand, through the medium of a lever system, so as to be able to lower a part of the withdrawn rail section from a raised position down onto said fastener elements.

When using a plurality of such individual devices that can be fastened to and readily released from pairs of loosely laid sleepers, a technical problem resides in realizing the significance of and the advantages that are associated with the sequence in which said devices shall be activated in order to lower parts of the rail section onto said fastener elements in a pre-determined fashion.

Another technical problem is one of realizing the significance of and the advantage that are afforded by allowing said devices to be fastenable to adjacent sleepers and distributed along said sleepers in a pre-determined spaced relationship.

With regard to the actual design of said device, it will be seen that a technical problem resides in realizing the significance of allowing a rail-section support roller to be rotatably attached to mutually parallel end-wall parts, and to rotatably mount said end-wall parts on a sleeper-adapted frame structure.

It will also be seen that a technical problem resides in realizing the advantages that are afforded by mounting the shaft about which the roller rotates and the shaft about which the end-wall parts rotate side-by-side, so that when the roller is in a first fixed position, a lower position, said shafts will be horizontal or at least generally horizontal, whereas in a second fixed position of the roller, an upper position, the shafts will be positioned generally vertically.

It will also be seen that in the case of a device of this kind a technical problem is one of realizing the significance of and the simplifications that are afforded by causing said end-wall parts to extend beyond the support roller to an extent such as to form mutually opposing guide surfaces for guiding a rail section that is pulled past the sleepers and the requisite fastener elements.

Another technical problem is one of realizing the significance of and the advantages that are afforded by forming and arranging said end-wall parts such that a first edge surface thereof will be able to lie against a frame structure and therewith take a first fixed position, while a second angle-related edge surface is able to lie against said frame structure and therewith take second fixed position.

Another technical problem is one of creating conditions whereby said device will be able to turn the support roller from an upper fixed position to a lower fixed position through the medium of a separate manually operated lever device, and whereby the device can be readily removed from the sleepers with the support roller in this latter position.

Another technical problem is one of realizing the advantages that are afforded when said lever arm has the form of a rod that includes a pincer-like, end-related arrangement where one jaw is adapted to co-act with one end-wall while the other jaw is adapted to co-act with one of the cross-beams connecting said side-parts.

Another technical problem is one of realizing the significance of and the advantages that are afforded by constructing the sleeper-adapted fastener elements in the form of four frame-mounted pins or like elements that can move reciprocatingly in a respective sleeve attached to the frame structure.

It will also be seen that a technical problem resides in realizing the significance of and the advantages that are associated with allowing the distance between mutually opposing ends of two sleeves to be equal to or slightly shorter than the distance between adjacent sleepers, and to enabe the pins housed in said sleeves to move linearly away from each other and into coaction with a respective sleeper-associated, rail-adapted fastener element or like means.

Another technical problem resides in realizing the significance of lifting or raising rail sections with the aid of specially constructed devices and to distribute a few of these devices along the fall length of the previously positioned rail section, where each of said devices is adapted to extend between and rest against adjacent sleepers.

Still another technical problem is one of realizing the significance of and the advantages afforded by spacing the devices relatively far apart, e.g. at a distance of from 5 to 20 meters, normally about from 10 to 15 meters apart.

When the roller-equipped device adapted for use with the inventive method and including a frame structure having side-parts on which a roller is rotatably mounted it will be seen that a technical problem is one of providing a device construction in which the side-parts have a length that is equal to or slightly smaller than the distance between two adjacent sleepers, and to construct the device so that it can be moved in beneath the rails, even in the case of a preprepared railroad bed, and whose side-parts are provided with support means adapted to rest on the upper surfaces of said adjacent sleepers.

A particular technical problem in the present context is one of realizing the significance of and the advantages that are afforded by fastening two support elements belonging to a first side-part in relation to a (respective) side-part so that the distance between the outer surfaces of the two support elements will exceed the distance between said two adjacent sleepers.

Another technical problem is one of realizing the significance of and the advantages afforded by fixing two support elements belonging to a second side-part in relation to but displaceably coordinated with its respective side-part.

It is particularly proposed that said two support elements, in a inwardly moved position applicable to both elements, shall take a position in which the side-part of said device can be pushed freely between adjacent sleepers and beneath a rail section that extends over and is fastened to said sleepers.

SOLUTION

With the intention of solving one or more of the above technical problems, the present invention provides on the basis of method defined in the introduction a method in which a rail section withdrawn by a pulling vehicle is moved at a short distance above the loose sleepers and along a number of devices and through a path that conforms to the orientation of a number of sleeper-associated, rail-adapted fastener elements, wherewith linear movement of the rail section is adapted so that the trailing end-surface of the withdrawn rail section will be positioned adjacent a leading end-surface of an earlier lane and provisionally fastened rail section, and in which said devices are activated in this position such as to lower at least a part of said rail section onto said fastener elements.

According to proposed embodiments that lie within the scope of the inventive concept, the rail section is withdrawn by said pulling vehicle to an extent at which the trailing end-surface of said section passes beyond an opposing end surface of a provisionally fastened rail section, and the thus mutually opposing end-surfaces are caused to coact with one another through the medium of a pressure force.

It is proposed that a mobile unit for securing the rail section permanently to each underlying sleeper moves along rail sections behind the first wagon.

It is also suggested in accordance with the invention that a first device nearest a trailing end-surface will be activated before the other devices are activated.

It is also proposed that said devices shall be activatable in a consecutive order from said first agent.

According to the invention, respective devices are used in a raisable and lowerable support roller with side-related guide means.

The invention also enables said devices to be distributed along the sleepers at a mutual spacing of 1–10 meters, preferably 4–6 meters.

The present invention also teaches a method of creating conditions whereby a rail can be lifted and moved relative to a railroad sleeper and lowered onto said sleeper, therewith creating conditions for adapting or neutralizing tension forces acting in railroad rails that are fastened to railroad sleepers, in which the aforedescfibed sequence of steps is applied.

In accordance with the present invention, a rail section is lifted or raised with the aid of a number, a few, devices dispersed along the rail section and resting on two adjacent railroad sleepers, wherein said device is constructed to enable it to be readily moved in beneath a rail section that has been fastened to the sleepers, despite the fact that each of said devices includes a raisable and lowerable support surface which is active in respect of a part of a rail section positioned between the sleepers, and wherein the rail section with the support surfaces in a raised position is orientated slightly above the sleepers so that with the support surfaces in a lowered position said rail section will rest against the sleepers and special fastener elements belonging to said sleepers.

According to proposed embodiments of this method, the support surface has the form of a roller and a force is applied to said rail section so as to move said section over said rollers.

Each of the devices may be constructed to enable them to be raised and lowered by means of a hand-operated lever.

It is also proposed in accordance with the invention that the devices will be spaced far apart, such as at a distance of 5–20 meters, normally about 10–15 meters.

The invention also relates to a device that can be used in the inventive method and that includes a support roller which is rotatably and pivotally mounted on a frame structure, and also to sleeper-adapted fastener elements mounted in the frame structure.

It is also proposed in accordance with the present invention that the support roller is rotatably mounted on mutually parallel end-wall parts and that said end-wall parts are pivotally or rotatably attached to said frame structure, and that the shaft about which the support roller rotates and the shaft about which the end-wall parts rotate are located side-by-side.

In proposed embodiments that lie within the scope of the invention, when the roller is in a first fixed position, a lower position, the aforesaid shafts will be horizontal or at least generally horizontal in relation to each other.

It also proposed that the shafts will be essentially vertical in relation to each other in a second fixed position of the support roller, an upper position.

A hand-operated lever is adapted to rotate the roller to an upper position or to a lower position while the rail section exert a load on said roller.

It is particularly proposed that the lever has the form of a rod which includes a pincer-like, end-related arrangement, where one jawv is adapted to co-act with one end-wall, while the other jaw is adapted to co-act with one of the crossbeams that connect the side-parts.

It is also proposed that the end-wall parts extend beyond the support roller and therewith form mutually opposing guide surfaces for guiding a rail section that is drawn past and between said end-wall parts.

It is also proposed that the end-wall parts will be mutually identical and both arranged so that a first edge surface thereon can abut the frame structure so as to take said first fixed position, and to abut said stand structure with another edge surface such as to take said second fixed position.

According to one proposed embodiment, the sleeper-adapted fastener elements are of simple construction and consist of four frame-mounted shafts or like elements that are reciprocatingly movable in respective sleeves mounted on the frame structure.

It is particularly proposed that the distance between the mutually opposing ends of two sleeves is equal to or slightly less than the distance between mutually adjacent sleepers, and that the shafts are movable away from each other for coaction with a respective sleeper-associated, rail-adapted fastener device or the like.

According to one embodiment, the frame structure embodies four corner-related, sleeper-adapted fastener elements.

As an alternative embodiment the present invention proposes that the length of the side-parts belonging to the frame structure are equal to or slightly shorter than the distance between two adjacent sleepers, and that two side-parts are provided with mutually opposite support elements, which support elements constitute said fastener elements, and which are adapted to support and rest against the upper surfaces of said two adjacent sleepers.

According to further embodiments that lie within the scope of the inventive context, two support elements belonging to a first side-part are fixed in relation to a respective side-part.

In addition, two support elements belonging to a second side-part are fixed in relation to a respective side-part but displaceably coordinated therewith.

Particularly in respect of these latter support elements, it is proposed that when said elements are in an inwardly moved, close position, they will take a position in which one of the side-parts of said device caHi be moved between two sleepers and beneath a rail section resting on said sleepers.

ADVANTAGES

Those advantages that are primarily afforded by the inventive method reside in the provision of conditions whereby railroad rail sections and parts thereof can be drawn over loosely positioned railroad sleepers placed on a prepared railroad bed, without the positions of the sleepers being changed by the rail section as it is drawn over and beyond said sleepers.

The present invention further provides a method through which conditions are created that enable a rail to be lifted and moved relative to a railroad sleeper and to be lowered onto saud sleeper in a quicker and simpler fashion than is possible with known methods, and therewith provide conditions for adapting or neutralizing tension forces acting in rail sections that are secured, fastened, to underlying sleepers.

The advantages primarily afforded by the inventive device reside in the provision of conditions whereby the devices can be fastened to mutually adjacent, loose railroad sleepers by coaction with sleeper-associated, rail-adapted fastener elements or the like, and therewith conditions whereby the device can be fixedly positioned satisfactorily and with which a support roller belonging to said device can take a first fixed position, a lower position, in which parts of the rail section are out of contact with said device and rest against sleeper-associated, rail-adapted fastener elements, or a second fixed position, an upper position, where parts of the rail section can be moved linearly over and beyond said sleepers via roller friction.

The primary characteristic features of the inventive methods are set forth in the characterizing clause of the following claims 1 and 8, while the primary characteristic features of an inventive device are set forth in the characterizing clause of the following claim 11.

BRIEF DESCRIPTION OF THE DRAWINGS

A preferred embodiment of the inventive methods and an inventive device for use herewith will now be described in more detail with reference to the accompanying drawings, in which.

DESCRIPTION OF EMBODIMENTS AT PRESENT PREFERRED

Figure 1:
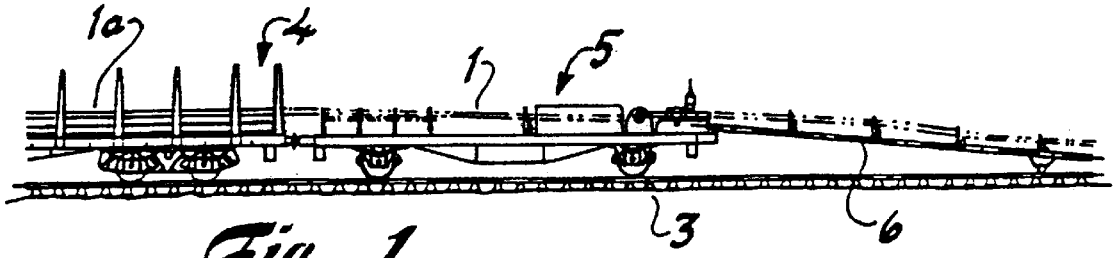
FIG. 1 is a side view of a first railroad wagon which carries a store of rail sections, and a second railroad carriage having an associated ramp for moving rail sections linearly from said first wagon and into abutment with loose railroad sleepers placed along and resting loosely on a railroad bed.
Figure 2:
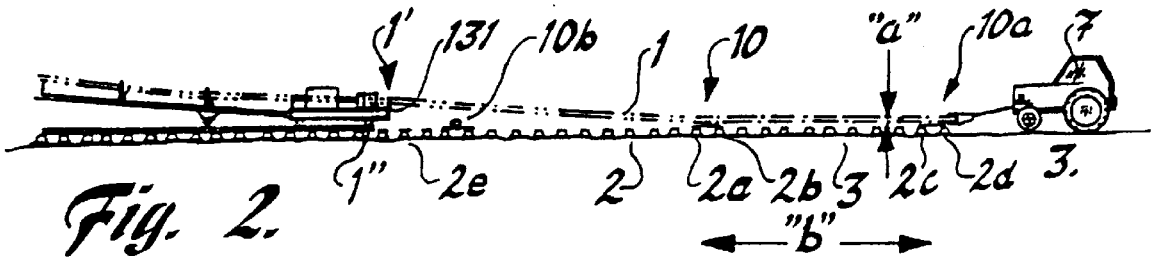
FIG. 2 is a continuation of FIG. 1 and shows inventive devices disposed between pairs of railroad sleepers for supporting parts of the rail section.
Figure 3:
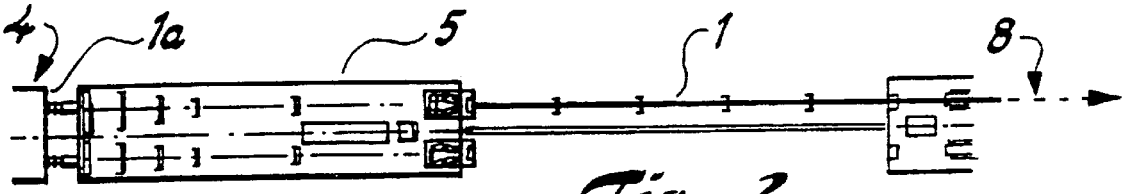
FIG. 3 is a horizontal view of part of the arrangement shown in FIG. 1.

Described below with reference to FIGS. 1, 2 and 3 is a method of placing, positioning, provisionally fastening and permanently fastening railroad rail sections 1 on railroad sections on a number of mutually adjacent and mutually spaced loose railroad sleepers 2, where some of the adjacent sleepers have been referenced 2*a*, 2*b* and 2*c*, 2*d* respectively and which will be described in more detail below.

Each of the sleepers 2 is placed loosely on a prepared railroad bed 3 and, for the sake of simplicity, it is assumed that the sleepers 2 are placed equidistantly, although they will be spaced at different distances apart in practice.

The method illustrated in FIGS. 1–3 utilizes a first railroad wagon 4 which is adapted to carry a number of rail sections $\mathbf{1}_1$, a second wagon 5 with associated ramp 6 or like device which is adapted to guide rail sections 1 from the rail sections $\mathbf{1}_1$ on the first wagon 4 onto the sleepers 2, and a pulling vehicle 7, shown schematically in FIG. 2, which functions to draw a rail section 1 from the first wagon 4 into abutment with said sleepers 2, via said second wagon 5 and the ramp 6.

The second wagon 5 carries a number of hydraulically raisable and lowerable support rollers and other means for facilitating axial movement of the rail sections, as described in more detail below with reference to FIGS. 14–17.

When the rail section 1 has been drawn by the vehicle 7 to an extent at which the opposite end 1' of said rail section is able to fall down into a shute 131 and against a device 10*b*, said end 1' will be located at a distance from the front or adjacent end 1" of a rail resting on the sleepers.

The rail section 1 is displaced or pushed back so that the endsurface 1' will make contact with the previously provisionally fastened rail section with the endsurface 1".

The mutually facing end surfaces of the two rail sections will be joined together between two sleepers with the aid of special means herefor.

The rail section 1 is lowered down onto the sleepers with the aid of a number of devices (10, 10*a*, 10*b*) and manually fastened provisionally to selected sleepers, for instance every twenty meters, as described in more detail below.

This enables laid rail sections 1 to serve as tracks for the wagons 4 and 5 and the ramp 6.

The wagon 4 is followed by a mobile unit which travels along pairs of laid and provisionally fastened rails and which fastens parallel rail sections pennanently to each underlying sleeper, by applying selected fasteners to sleeper-associated fastener devices or to rail-adapted surfaces or the like. The earlier provisional fastening can be removed.

A mobile unit that can be used beneficially for this part of the method of permanently securing rail sections to railroad sleepers is illustrated and described in more detail in European Patent Application 95900971.3. (Corresponding to International Patent Application PCT/SE94/01042).

The mobile unit illustrated and described in Swedish Patent Application 9601965-8 can also be used in this respect.

For the sake of simplicity, the mobile unit has not been shown in the drawings, since its positioning and function are obvious.

A significant feature of the present invention is that the rail section, such as the section 1, pulled from the rail storage wagon by the vehicle 7 shall be moved axially and with small friction at a distance "a" above the sleepers 2. This is achieved in accordance with the invention with the aid of a number of devices, three of which are shown in FIG. 2 and referenced 10, 10*a* and 10*b*. The devices 10, 10*a* and 10*b* each incorporate a support roller for supporting at least a part of the rail section 1.

The devices 10, 10*a* are positioned sequentially at an adapted distance apart (e.g. six to fifteen, normally eight or nine loose sleepers between each device) and giving said rail section a direction 8 conforming to the direction of sleeper-associated, rail-adapted fastener devices, so that the rail section will always be located adjacent to and above said fastener devices.

The extent to which a rail section is moved axially is adapted so that the rear end surface 1' of the rail section 1 drawn from the wagon will pass beyond the end of the rail section 1" through a limited distance, and such that the terminating part of said rail section 1 will fall into a shute 131 and down into abutment with the device 10*b*.

When necessary, the device 10*b* is lowered so that the terminating part of the rail section 1 will rest against the sleeper 2*e*, whereafter the whole of the rail section is pushed back.

The end surface 1' will then be positioned adjacent a front end surface 1" of an earlier laid rail section. With the rail sections in this position, the devices 10, 10*a* are activated so as to lower at least a part of the rail section 1 onto said fastener devices in the sleepers 2*a*, 2*b* and 2*c*, 2*d* respectively.

These end surfaces can now be welded together or fastened in some other known manner.

According to the present invention, a first device 10*b* located nearest the rear end surface 1' is activated first before the remaining devices 10 and 10*a* are activated. It will be particularly noted that the devices 10, 10*a* can be activated in a consecutive order from the first device 10*b* to a last device.

The number of devices used will depend on the length of the rail section and is much greater than the illustrated number of three devices.

The devices 10 mnay be comprised of manually raisable and lowerable support rollers which have side-related guide means and which are raised and lowered manually by means of a lever (not shown).

The devices 10, 10*a*, 10*b* may be distributed along the railroad sleepers 2 with a distance between mutually adjacent devices of 1–10 meters, preferably 4–6 meters, said distance being referenced "b" in FIG. 2.

It is proposed that each device 10, 10*a* is separated by six-twelve sleepers.

The present invention also relates to an improvement in a method of creating conditions which enable a rail to be lifted and moved in relation to a railroad sleeper and lowered onto said sleeper, therewith having created conditions for adapting or neutralizing tension forces acting in a rail that has been fastened to railroad sleepers.

Figure 5:
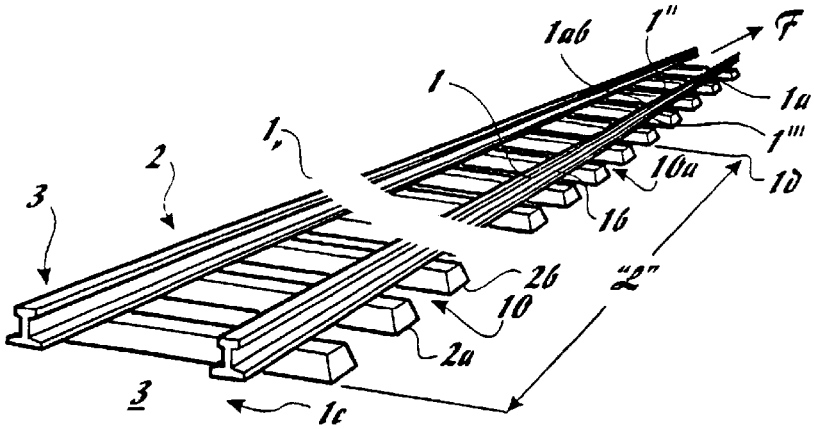
FIG. 5 is a perspective view of part of a railroad track, showing two mutually parallel rails supported by a number of railroad sleepers.

Shown in FIG. 5 are two mutually parallel rail sections 1 and $\mathbf{1}_p$ resting on a number of railroad sleepers in a known manner.

The sleepers 2 rest on a prepared railroad bed 3 and two mutually adjacent sleepers have been referenced 2*a* and 2*b*, this number of sleepers being sufficient to explain the invention.

The rails 1 and $\mathbf{1}_p$ are held in place by means of fastener devices that coact with sleeper mounted fastener elements.

Various different fastener devices, e.g. in the form of spring units, and various different fastener elements are known to the art, and the invention is not dependent on either the choice of fastener device or the choice of fastener element.

Since the inventive method can be applied in respect of both rails 1 and $\mathbf{1}_p$, the method will be described in the following solely with reference to the rail 1, for the sake of simplicity.

The rail 1 is "jointless", meaning that rail sections are welded to rail sections, end to end.

In the case of such an application, the rail 1 will have been tensioned to an adapted tensile force when it is to be fastened to the railroad sleepers. This tension force is necessary in order for the rail to withstand the forces exerted by heavy railroad traffic and to compensate for length changes caused by temperature variations.

In order to clarify the features of the present invention, it is assumed that the rail 2 is comprised of three rail sections 1*a*, 1*b* and 1*c* having a length (say 100 to 200 meters) that exceeds the length given in FIG. 5.

The rail section 1*a* is shown furthest away from the viewer, the section 1*b* is shown centrally of the figure and merges with a section 1*c* (not shown), with the intermediate rail section 1*b* having a length "L".

The tension acting in the rail section 1*b* shall now be adapted or neutralized, i.e. any over-tensioning or under-tensioning of the rail section shall be adjusted to an adapted or "nominal" tension force.

The present invention is based on a method that comprises cutting-away the end-part 1*ab* of the rail 1 at the point reference 1*b*. This end-part 1*ab* may represent solely a cutting groove or a short rail section.

The method is also based on the procedure of loosening all fastener devices between sleepers 2 and rail 1 along an adapted rail section 1*b*, the length of which is referenced "L".

Subsequent to completely removing the fastener devices, the rail section 1*b* shall be raised or lifted above the loosened sleepers 2.

A pre-determined force F is then applied to the end-surface 1"' of the rail section 1*b* in the longitudinal direction of the rail, this force being applied with the aid of known devices which will not be described in this document.

Subsequent to applying the force F, an end-surface 1"' of the rail section 1*b* is fastened to an end-surface 1", an exposed end-surface, of an adjacent rail section 1*a* that has been fastened to the sleeper 2, under the influence of said force.

The loose rail section 1*b* that is acted upon by said force can then be fastened to underlying sleepers 2 with the aid of known fastener elements.

It will be obvious that the tensile forces F acting on the rail section 1*b* shall occur with small friction against the sleepers, and consequently the rail section 1*b* may not rest directly on the sleeper fastener elements 2.

According to the present invention, the rail section 1*b* is raised or lifted as desired with the aid of a number (a few) devices 10 that are distributed along the rail section 1*b* and that rest on two adjacent sleepers 2*a*, 2*b*.

Each device 10, 10*a* used is thus positioned between pairs of adjacent sleepers.

It will be noted here that the number of devices 10 used in practice and the distance "L" may be more and longer than that shown in FIG. 1.

The devices 10, 10*a* might be mutually identical.

Figure 21:
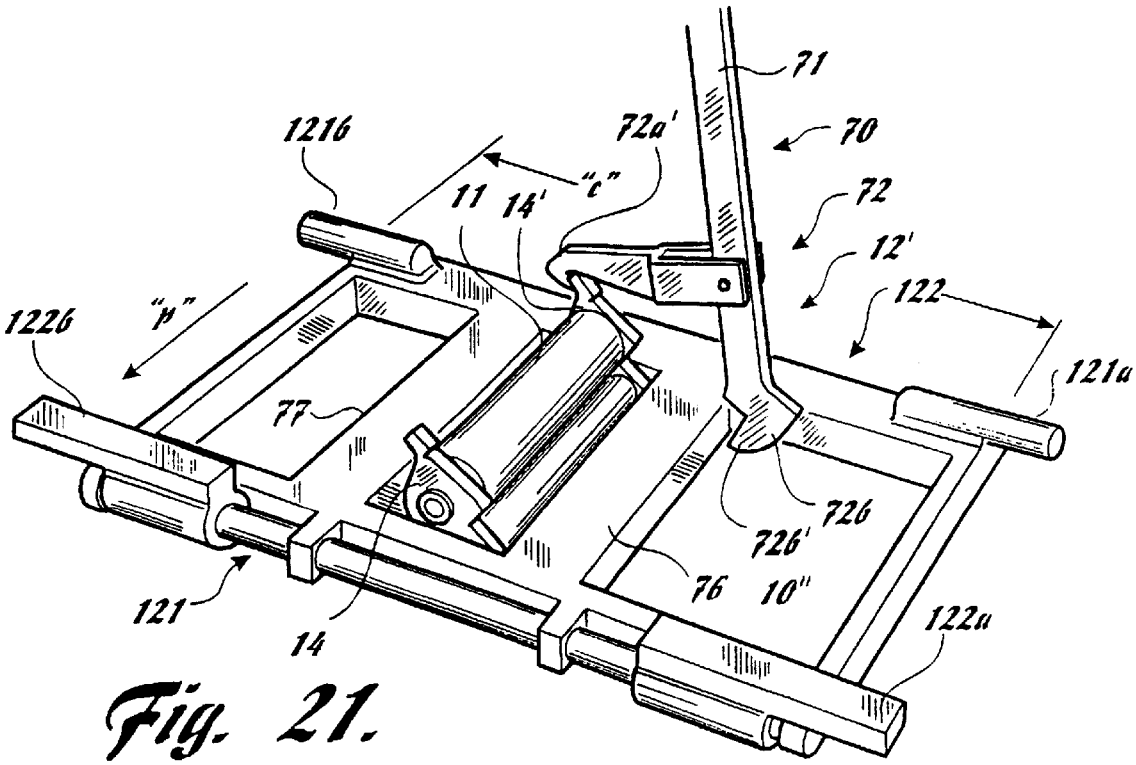
FIG. 21 is a perspective view of the roller-equipped device with the device in co-action with a hand-operated lever that comprises a rod and a pincer-like, end-related arrangement.

Each of the devices 10 can be raised and lowered with the aid of a hand-operated lever which is shown in more detail in FIG. 21.

It is also proposed in accordance with the invention that the devices 10, 10*a* shall be spaced apart at distances of 5–20 meters, normally about 10–15 meters.

Figure 4:
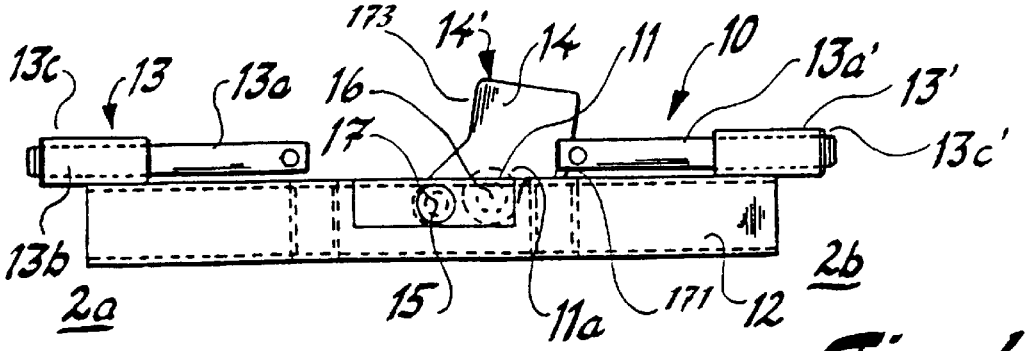
FIG. 4 is a side view of an inventive device, with the support roller located in a lower position.

The present invention also relates to a device which is adapted for use in the any of the aforedescribed methods. This device 10 includes a support roller 11 which is rotatably mounted in a frame arrangement 12 which carries diametrically positioned, sleepers-adapted fastener elements, of which two such fastener elements 13, 13' are shown in FIG. 4.

It will be noted that the illustrated fastener elements 13, 13' are adapted to sleeper-associated, rail-adapted fastener devices that include holes.

Naturally, other fastener elements (13, 13') are required for other fastener devices.

The support rollers 11 are rotatably attached to parallel end-wall parts 14, 14' in a known manner, said end-wall parts being, in turn, rotatably attached to said frame arrangement 12 at 15. The shaft 16 about which the roller 11 rotates and the shaft 17 about which the end-wall parts 14, 14' rotate are arranged side-by-side.

As evident from FIG. 4, in a first fixed position of the support roller 11, a lower position, the shafts 16, 17 are horizontal in relation to each other, or at least generally horizontal, and the support surface, or peripheral surface, 11*a* of the support roller 11 is located at a short distance beneath an overlying part of the rail section 1, which then rests in sleeper-associated fastener devices.

In this position and with the fastener elements 13, 13' out of engagement with the fastener devices, the element can be easily removed.

Figure 8:
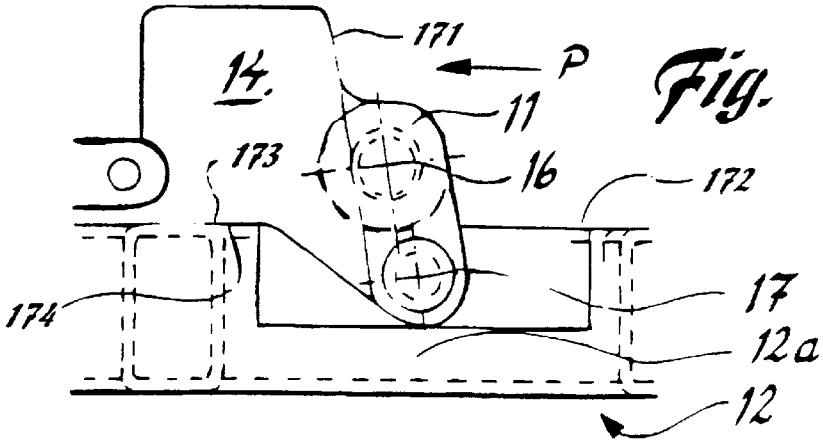
FIG. 8 is an enlarged side view of part of the device shown in FIG. 4, with the support roller in an upper position.

FIG. 8 illustrates a second fixed position of the support roller 11, an upper position, in which the shafts 16, 17 are generally vertically positioned in relation to each other with the shaft 16 lying in a vertical plane through the shaft 17 in the pulling direction.

By pulling in the direction "P" in FIG. 8, the support roller 11 is caused to take the fixed position shown in FIG. 8.

As will be evident from FIGS. 4 and 8, the end-wall parts 14, 14' are so formed in said two fixed positions that they both form together with the device coacting with fastener devices in the sleepers, mutually opposed guide surfaces which function to guide the pulled or adapted rail section such that said rail section will always be located above the fastener devices.

The end-wall parts 14, 14' have a first edge surface 171 intended for abutment with an edge surface 172 on the frame arrangement 12 such as to take said first fixed position, and a second edge surface 173 intended for abutment with an edge surface 174 on the frame arrangement 12 so as to take said second fixed position (FIG. 8).

The sleeper-adapted fastener elements 13, 13' might be mutually identical, and consequently, only an alternative embodiment of a possible fastener element 13 will be described hereinafter.

The fastener element is comprised of a frame-mounted shaft 13*a* which can be move reciprocatingly in a sleeve 13*b* attached to the frame structure 12 in a known manner. The shaft 13*a* is shown in its withdrawn position in FIG. 4, and when moved to a position (not shown) to the left in FIG. 2, the shaft 13*a* is able to coact with a sleeper-adapted fastener device in the form of a fastener lug or hole.

The distance between mutually opposing ends 13*c*, 13*c'* of two coordinated fastener devices 13, 13' is the same as or slightly shorter than the distance between adjacent sleepers 2*a*, 2*b*. The shafts 13*a*, 13*a'* can be moved away from one another for coaction with a respective sleeper fastener device 2*a*, 2*b*.

Figure 7:
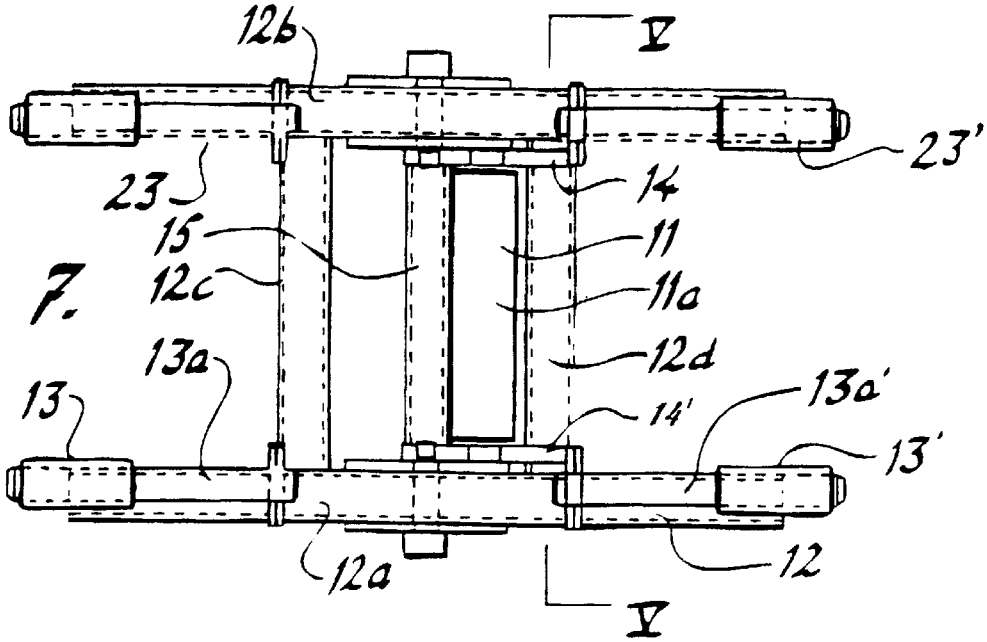
FIG. 7 is a horizontal view of the device shown in FIG. 4.

FIG. 7 shows a frame structure 12 having a sleeper fastener element 13, 13' and 23, 23' in rspective comners of the structure.

The frame structure 12 has two mutually parallel parts or side parts 12*a*, 12*b* which are joined mutually by two parallel transverse parts 12*c* and 12*d*.

Figure 9:
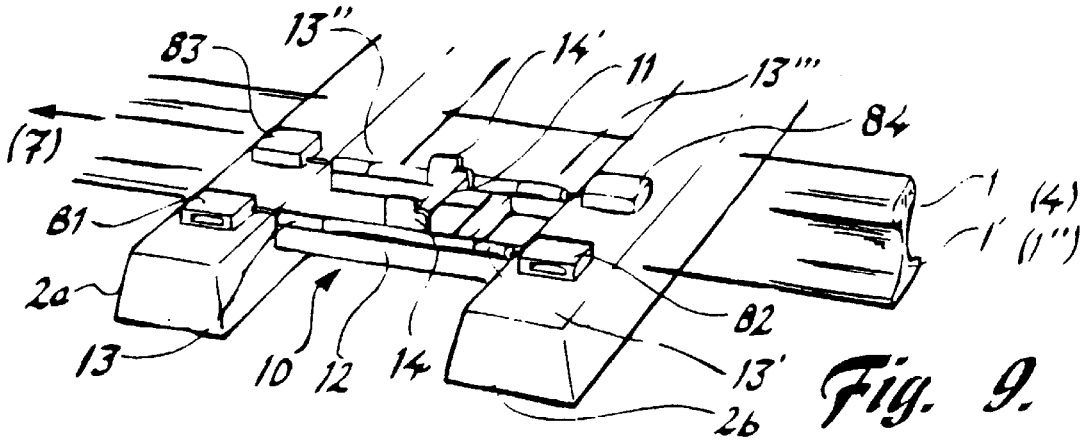
FIG. 9 is a perspective view that illustrates the positioning and fastening of a device between two adjacent sleepers, with a first embodiment of a fastener element.

As will be seen from the respective view shown in FIG. 9, a device 10 is placed inbetween adjacent sleepers 2*a*, 2*b*. It will also be seen from FIG. 9 that said device can be removed, by deactivating the fastener elements 13, 13' and fastener devices 81, 82 and dropping said device down between the sleepers.

FIG. 9 shows the fastener elements 13, 13' and the parallel fastener elements 13", 13'" in a position of coaction with sleeper-associated fastener devices 81, 82 and 83, 84 respectively adapted for E-clips.

Figure 10:
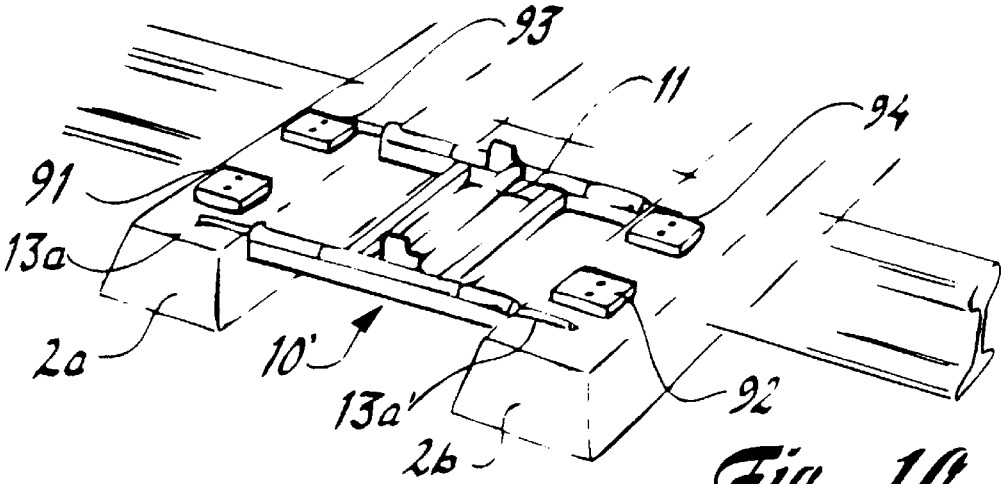
FIG. 10 is a perspective view illustrating the positioning and fastening of a device between two adjacent sleepers, with a second embodiment of fastener elements.

FIG. 10 illustrates in perspective the positioning and attachment of a device 10' between two adjacent sleepers 2*a*, 2*b*. In the case of this embodiment; the sleepers are fastened with devices 91–94 that are adapted for coaction with screws or like means.

The fastener elements 13*a*, 13*a'* of the device 10' rest loosely against the upper surface of respective sleepers.

One further possible embodiment of a fastener element 13 is described with reference to FIG. 11, where the inventive roller-equipped device 10" includes a frame arrangement 12' (see FIG. 21) that has mutually parallel side-parts 121, 122.

The side parts 121, 122 have a length "a" which is equal to or slightly shorter than the distance "b" between two mutually adjacent sleepers 2*a*, 2*b*, said side-parts 121, 122 being provided with double support elements that are intended to rest on the upper surfaces of said sleepers 2*a*, 2*b*.

It will be noted in particular that two support elements 121*a*, 121*b* belonging to a first side-part 121 are fixedly related to the side-part 121 and constitute more and less an extension of said side-part 121 beyond the distance "c" and the distance "d".

Althouugh two support elements 122*a*, 122*b* belonging to a second side 122 are fixedly related in relation to said side-part, said support elements can be displaceably coordinated with said side-part 121 in a manner described in more detail hereinafter.

The support elements 122*a* and 122*b* are mutually identical, and hence only the support element 122*a* will be described hereinafter.

Figure 12:
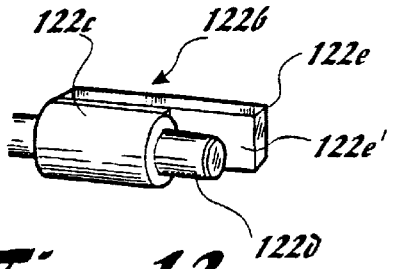
FIG. 12 is a perspective view of one of two associated support elements, with the elements in a fully inserted position.

As will be seen from FIG. 12, the support elements 122*a* are comprised of a sleeve 122*c* which can be moved along a pin 122*d* and which there co-acts with a plate 122*e*.

Figure 11:
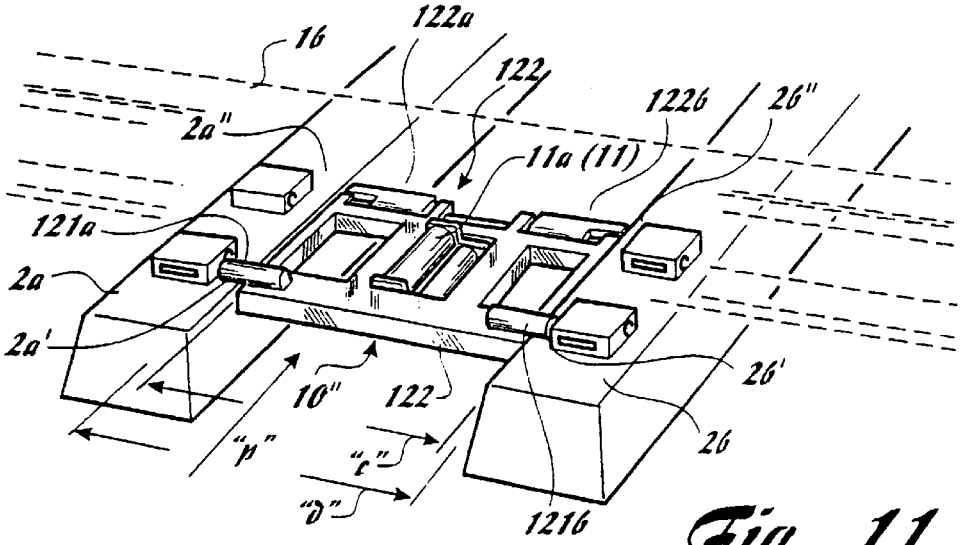
FIG. 11 is a perspective view of an inventive roller-equipped device, and shows the device inserted between two sleepers and beneath a loosened rail section, shown in broken lines.

FIG. 12, and also FIG. 11, show the support element 122*a* in an inwardly moved position.

The support element 122*a*, 122*b* shall be inactive as the support surface is inserted in the direction of arrow P. The frame arrangement 12' shall have a thickness of about 2–5 cm (about 3 cm) so as to enable it to be moved under a rail section 1*b* fastened to sleepers 2*a*, 2*b*, a distance of 5–7 cm being available to this end.

This enables practically the entire frame arrangement 12', and at least the side-part 122 and the roller 11 of said device, to be moved freely between two sleepers 2*a*, 2*b* (in the direction of arrow P), and beneath a rail section to the position shown in FIG. 11.

When the device 10" is located in a centered position beneath the rail section 1*b*, the fixed support element 121*a* and 122*b* will be able to rest on the support surfaces 2*a'* and 2*b'*.

Figure 13:
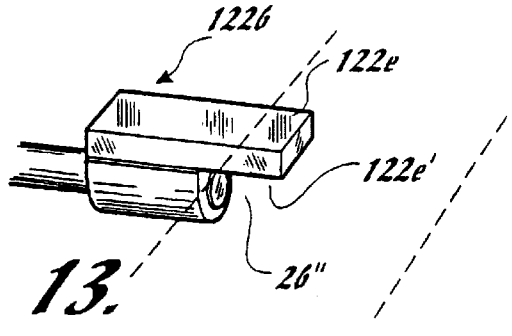
FIG. 13 is a perspective view of the support element shown in FIG. 12, with the support element in an outwardly withdrawn position adapted for co-action with the upper surface of the sleeper.

When the device 10" and the support elements 122*a*, 122*b* are located in the position shown in FIG. 11, each support-element plate 122*e* shall be turned from the position in FIGS. 11 aad 12 to a position corresponding to that shown in FIG. 13, whereafer the sleeve 122*c* and the plate 122*e* are moved outwards, so that the surface 122*e'* of the plate 122*e* is able to co-act supportively with the support surfaces 2*b"* of the sleeper concerned.

The support element 122*a* can be caused to co-act with the support surface 2*a"* in a corresponding manner.

The pin 112*d* is comprised of a part of a rod 122*d* that extends along the side-part 122.

Figure 14:
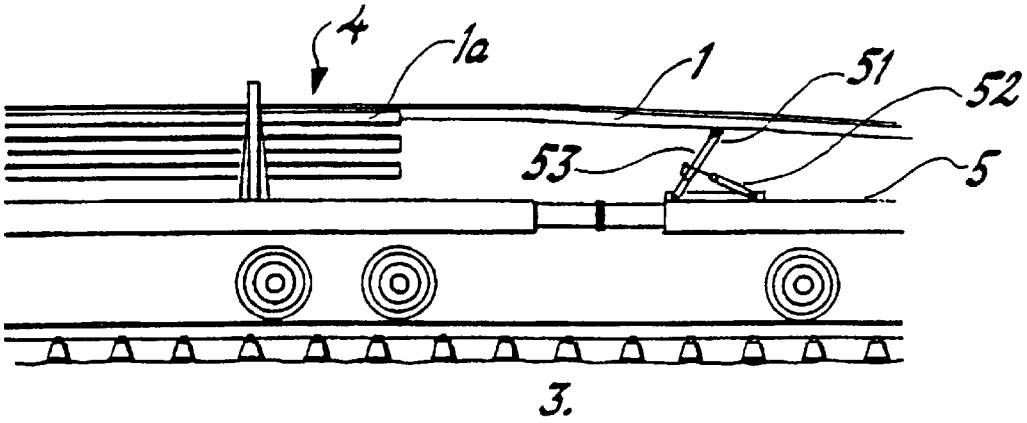
FIG. 14 is a more detailed side view of the support roller belonging to the second railroad wagon.

FIG. 14 is a side view which illustrates a support roller 51 belonging to the second wagon 5 in more detail the support roller 51 can be raised and lowered by an hydraulic piston-cylinder device 52 tt acts on a lever 53.

Figure 15:
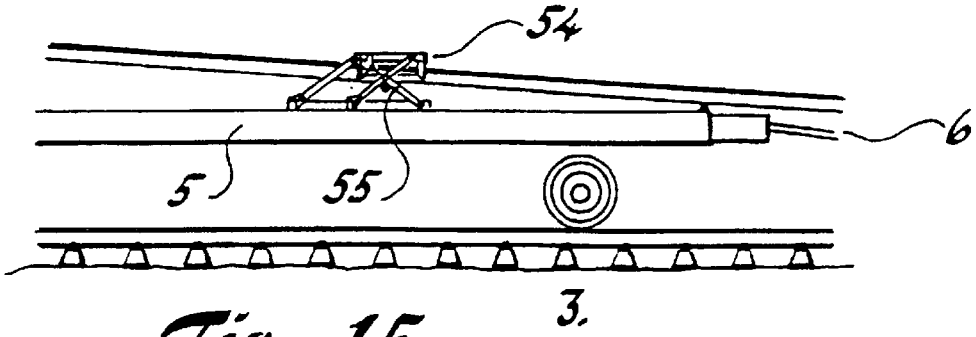
FIG. 15 is a side view illustrating the supporting and aligning device belonging to the second wagon in more detail.

FIG. 15 is a side view which illustrates in more detail the supporting and aligning device belonging to the second wagon 5. This device includes four rollers 54 which guide the rail section 1 vertically and laterally, via the piston-cylinder device.

Figure 16:
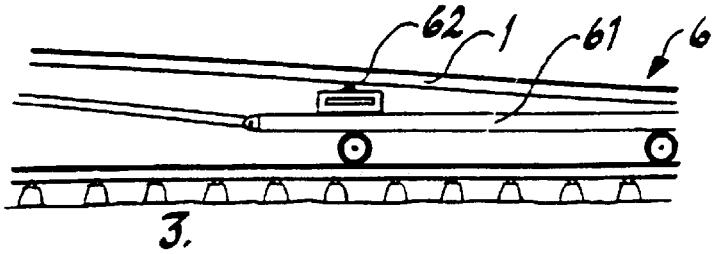
FIG. 16 is a side view of a ramp arrangement.
Figure 17:
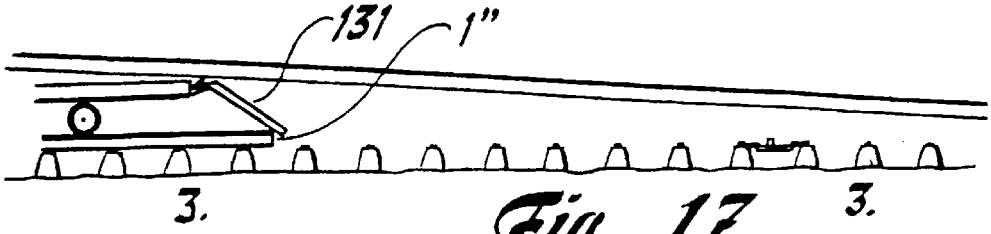
FIG. 17 is a side view of a shute that terminates the ramp arrangement.

FIG. 16 is a side view of a ramp arrangement that includes a carriage 61, the front part of which carries a support roller 62 and the rear part of which has a shute 131, in accordance with FIG. 17.

Figure 6:
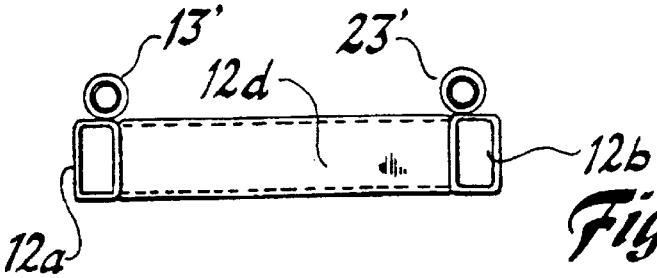
FIG. 6. is an end view of the device shown in FIG. 4.
Figure 18:
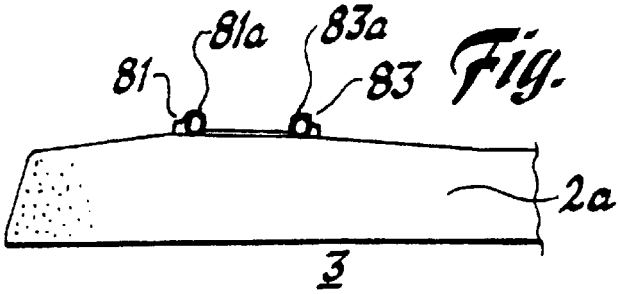
FIG. 18 is a side view of a railroad sleeper with which the device in FIGS. 4, 6 and 7 can be used.

FIG. 18 is a side view of a railroad sleeper with which the device 10 according to FIGS. 4, 6 and 7 can be used, since the fastener devices 81 and 83 have holes 81*a*, 83*a* into which the pins (13*a*) can be inserted.

Figure 19:
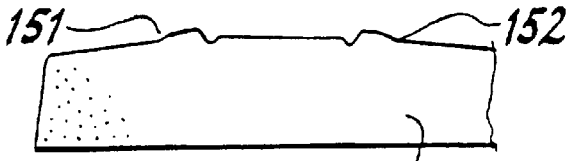
FIG. 19 is a side view of a railroad sleeper with which the fastener elements shown in FIG. 10 can be used.

FIG. 19 is a side view of a railroad sleeper with which the device 10' shown in FIG. 10 can be uses.

In this respect, it is necessary for the sleeper 2*a* to have a surface section 151 and 152 against which the fastener elements can rest.

Figure 20:
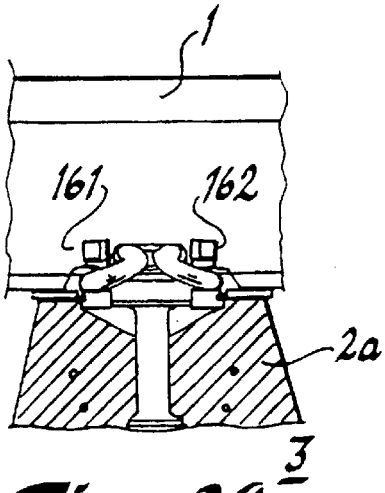
FIG. 20 is a sectional view of a sleeper with which the device shown in FIGS. 4, 6 and 7 or the device shown in FIG. 10 can be used.

FIG. 20 s a sectional view of a railroad sleeper with which the device 10 or the device 10' can be used. It will be noted that the pins (13*a*) shall be capable of coacting with the respective recesses 161 and 162.

FIG. 20 illustrates a number of railroad sleepers 2*a*, 2*b* with alternative fastener devices 91, 92 and 93, 94 respectively and therewith a corresponding, simple adaptation of the device 10'.

FIG. 21 illustrates a hand-operated lever 70 is intended for rotating the support roller 11 to its upper position (shown in FIG. 8) or to its lower position (shown in FIG. 4) while the roller is subjected to the load of the rail section 1*b*.

The lever 70 has the form of a rod 71 that has a pincer-like, end-related arrangement 72, where one jaw is able to co-act with one end-part 14' through the medium of hook 72*a*', whereas the other jaw 72*b* is able to co-act through the medium of a hook 72*b*' with one of two cross-bars 76, 77 that interconnect the side-parts 121, 122.

It will understood that the invention is not restricted to the aforedescribed and illustrated embodiments thereof and that modifications can be made within the scope of the following claims.

What is claimed is:

1. A method of placing, positioning and fastening railroad sections on a number of mutually adjacent and mutually spaced loose railroad sleepers, the sleepers each resting loosely on a railroad bed, comprising the steps of:

carrying a store of railroad sections on a first railroad wagon;

moving a pulling vehicle along a railroad bed;

pulling railroad sections from the first wagon into abutment with loosely placed sleepers on the railroad bed with the pulling vehicle;

moving railroad sections pulled by the pulling vehicle at a distance above the loosely placed sleepers and along a number of railroad section fastener devices supported by the loosely placed sleepers and through a path conforming to an orientation of the railroad section fastener devices, the railroad sections being moved so that a rear end surface of a pulled railroad section is positioned adjacent a front end surface of an earlier pulled railroad section;

activating at least one of the railroad section fastener devices when one of the railroad sections is moved so that its rear end surface is positioned adjacent a front end surface of an earlier pulled railroad section so as to lower said railroad section onto said rail-adapted fastener devices; and following the first wagon with a mobile unit along ones of the railroad sections positioned on loosely placed railroad sleepers to fasten the railroad sections permanently to each loosely placed railroad sleeper.

2. A method according to claim 1, wherein the pulling vehicle pulls each railroad section through a distance such that a rear end surface of each railroad section, distal from the pulling vehicle, passes an opposing front end surface of an earlier pulled railroad section and wherein the rear end surface and the front end surface are caused to coact with one another.

3. A method according to claim 1, including activating a first one of the railroad section fastening devices located nearest at least one of the rear end surface and the front end surface for lowering a railroad section before activating other ones of the railroad section fastening devices.

4. A method according to claim 3, including activating each of the railroad section fastening devices in a consecutive order from the first one of the railroad section fastening devices.

5. A method according to claim 4, including using a raisable and lowerable support roller, with side-related guide means, as at least the first one of the railroad section fastening devices.

6. A method according to claim 4, wherein the railroad section fastening devices are distributed along the railroad sleepers at a mutual distance apart of 1–10 meters.

7. A method of placing, positioning and fastening railroad sections on a number of mutually adjacent and mutually spaced loose railroad sleepers, the sleepers each resting loosely on a railroad bed, comprising the steps of:

carrying a store of railroad sections on a first railroad wagon;

moving a pulling vehicle along a railroad;

pulling railroad sections from the first wagon into abutment with loosely placed sleepers on the railroad bed with the pulling vehicle;

moving railroad sections pulled by the pulling vehicle at a distance above the loosely placed sleepers and along a number of railroad section fastener devices supported by the loosely placed sleepers and through a path conforming to an orientation of the railroad section fastener devices, the railroad sections being moved so that a rear end surface of a pulled railroad section is positioned adjacent a front end surface of an earlier pulled railroad section;

activating at least one of the railroad section fastener devices when one of the railroad sections is moved so that its rear end surface is positioned adjacent a front end surface of an earlier pulled railroad section so as to lower said railroad section onto said rail-adapted fastener devices;

following the first wagon with a mobile unit along ones of the railroad sections positioned on loosely placed railroad sleepers to fasten the railroad sections permanently to each loosely placed railroad sleeper;

activating a first one of the railroad section fastening devices located nearest at least one of the rear end surface and the front end surface for lowering a railroad section before activating other ones of the railroad section fastening devices; and using a raisable and lowerable support roller, with side-related guide means, as at least the first one of the railroad section fastening devices.

8. A method according to claim 7, wherein the railroad section fastening devices are distributed along the railroad sleepers at a mutual distance apart of 1–10 meters.

9. A method of placing, positioning and fastening railroad sections on a number of mutually adjacent and mutually spaced loose railroad sleepers, the sleepers each resting loosely on a railroad bed, comprising the steps of:

carrying a store of railroad sections on a first railroad wagon;

moving a pulling vehicle along a railroad;

pulling railroad sections from the first wagon into abutment with loosely placed sleepers on the railroad bed with the pulling vehicle;

moving railroad sections pulled by the pulling vehicle at a distance above the loosely placed sleepers and along a number of railroad section fastener devices supported by the loosely placed sleepers and through a path conforming to an orientation of the railroad section fastener devices, the railroad sections being moved so that a rear end surface of a pulled railroad section is positioned adjacent a front end surface of an earlier pulled railroad section;

activating at least one of the railroad section fastener devices when one of the railroad sections is moved so that its rear end surface is positioned adjacent a front end surface of an earlier pulled railroad section so as to lower said railroad section onto said rail-adapted fastener devices;

following the first wagon with a mobile unit along ones of the railroad sections positioned on loosely placed railroad sleepers to fasten the railroad sections permanently to each loosely placed railroad sleeper;

activating a first one of the railroad section fastening devices located nearest at least one of the rear end surface and the front end surface for lowering a railroad section before activating other ones of the railroad section fastening devices, wherein the railroad section fastening devices are distributed along the railroad sleepers at a mutual distance apart of 1–10 meters.

10. A method of lifting and moving a railroad section relative to railroad sleepers and lowering the railroad section onto the sleepers, said method comprising the steps of;

a) cutting away an end part of a railroad section;

b) loosening fastener elements between sleepers and the railroad section along a distance;

c) lifting the railroad section above loosened sleepers;

d) applying a force to one end of the railroad section in a direction of its longitudinal axis;

e) fastening the end surface of the railroad section to an exposed end-surface of an adjacent railroad section, the adjacent railroad section being fastened to railroad sleepers, under the action of the force; and f) fastening the railroad section as it is acted upon by the force to underlying railroad sleepers with the aid of the fastener elements, wherein the railroad section is lifted with the aid of a number of devices distributed along the railroad section and resting on mutually adjacent sleepers, wherein each device includes a raisable and lowerable support surface, active against a part of the railroad section, such that when raised, the support surfaces and the railroad section is orientated above the sleepers, when lowered, the support surface permits the railroad section to rest on the sleepers, and wherein the support surface includes a roller, and when the force is applied to the railroad section the railroad section is moved along the roller.

11. A method according to claim 10, wherein each of the devices can be raised and lowered with the aid of a hand-operated lever.

12. A method according to claim 10, including spacing the devices at a distance of 5–20 meters.

13. A device for lifting and lowering a railroad section, comprising:

a frame structure having side parts;

a support roller pivotally mounted in the frame structure;

sleeper-adapted fastener devices mounted on said frame structure, wherein the roller is rotatably mounted onto parallel end-wall parts that are pivotally attached to the frame structure, and a first shaft on which the roller rotates and a second shaft on which the end-wall parts rotate are arranged side-by-side.

14. A device according to claim 13, wherein the first and second shafts are adapted to be disposed in a first position in a generally horizontal condition in relation to each other.

15. A device according to claim 14, wherein the first and second shafts are adapted to be disposed in a second position in a generally vertical condition in relation to each other.

16. A device according to claim 15, including a hand-operated level, by means of which the roller can be turned to an upper position or to a lower position, while the roller is subjected to a load from the railroad section.

17. A device according to claim 14, wherein the end-wall parts are both arranged such that a first edge surface of each parts is adapted to lie against the frame structure and therewith be disposed in the first position, while a second edge surface of each part is adapted to abut with the frame structure in the second position.

18. A device according to claim 13, wherein the end-wall parts are adapted to form guide surfaces for part of a railroad section.

19. A device according to claim 13, wherein the sleeper-adapted fastener elements are comprised of four shafts that are reciprocable in respective sleeves attached to the frame structure.

20. A device according to claim 19, wherein a distance between mutually opposite end-parts of at least two of the sleeves is equal to or slightly shorter than a distance between adjacent sleepers and ones of the shafts housed in each of the two sleeves are movable away from one another for coaction with a respective sleeper-associated, railroad-adapted fastener element.

21. A device according to claim 13, wherein a distance between mutually opposite end-parts of at least two of the sleeves is equal to or slightly shorter than a distance between adjacent sleepers and ones of the shafts housed in each of the two sleeves are movable away from one another for coaction with a respective sleeper-associated, railroad-adapted fastener element.

22. A device according to claim 21, wherein the frame structure includes four sleeper-adapted fastener elements.

23. A device according to claim 13, wherein the frame structure includes four sleeper-adapted fastener elements.

24. A device according to claim 13, wherein the side-parts have a length which is equal to or slightly shorter than a distance between two mutually adjacent railroad sleepers and the side-parts are provided with the fastening elements, the fastening elements including two fixed and two movable support elements, that are adapted to rest on a top surface of said sleepers.

25. A device according to claim 24, wherein two support elements are associated with a first side-part and are fixedly related with a respective side-part.

26. A device according to claim 24, wherein two support elements are associated with a second side-part and are fixedly related to but displaceably coordinated with a respective side-part.

27. A device according to claim 24, wherein the support elements are adapted to be disposed in an inserted position in which one of the side-parts of the device can be inserted in between railroad sleepers and beneath a railroad section.

28. A device according to claim 13, including a hand-operated level, by means of which the roller can be turned to an upper position or to a lower position, while the roller is subjected to a load from the railroad section.

29. A device according to claim 28, wherein the lever has the form of a rod including an end arrangement including a jaw adapted for coaction with one end-wall and another jaw adapted for coaction with a cross bar interconnecting said side-parts.

* * * * *